US005988101A

United States Patent [19]

Jacobs et al.

[11] Patent Number: 5,988,101

[45] Date of Patent: Nov. 23, 1999

[54] SAFETY DIRECTIONAL LINE FOR UNDERGROUND MINING AND METHOD OF MAKING SAME

[76] Inventors: William J. B.. Jacobs; Tanya S. Jacobs; Mark W. Jacobs, all of P.O. Box 429, Sylvester, W. Va. 25193

[21] Appl. No.: 09/032,757

[22] Filed: Feb. 27, 1998

[51] Int. Cl.[6] ..... G08B 6/00

[52] U.S. Cl. ..... 116/205; 116/202; 116/DIG. 17; 182/18

[58] Field of Search ..... 116/205, 200, 116/201, 202, 209, DIG. 17; 182/18, 206, 230

[56] References Cited

U.S. PATENT DOCUMENTS

| | | | |
|---|---|---|---|
| 257,781 | 5/1882 | Sullivan | 182/206 |
| 326,616 | 9/1885 | Woodbury et al. | 182/206 |
| 4,179,160 | 12/1979 | Sabo | 116/205 |
| 4,401,050 | 8/1983 | Britt et al. | 116/205 |
| 4,844,000 | 7/1989 | Clement | 116/205 |
| 5,027,741 | 7/1991 | Smith et al. | 116/205 |
| 5,612,665 | 3/1997 | Gerhardsen | 116/205 |

FOREIGN PATENT DOCUMENTS

| | | | |
|---|---|---|---|
| 2224154 | 4/1990 | United Kingdom | 116/205 |

*Primary Examiner*—Andrew Hirshfeld
*Attorney, Agent, or Firm*—Richard C. Litman

[57] ABSTRACT

A safety directional line for underground mining that can be adjusted during to conform with any local codes. The line is constructed from high strength polypropylene which is non-conductive. A flame retardant is added to the polypropylene to make it flame resistant. There are flame retardant and non-conductive directional indicator cones evenly spaced and positioned such that they are pointing along the axis of the line. The cones are placed on the line such that when someone is exiting the mine his hand slides along the slope of the cone and meets little resistance. In the event that the miner is traveling the wrong direction, his hand will meet the flat surface of the cone and come to a stop, indicating that he is traveling in the wrong direction. There is fluorescent tape on the cones to make it more clearly visible to one trying to exit the mine. The tape is formed in an X on the flat surface of the cone indicating that it is the wrong direction. Additionally, the tape is placed parallel to the axis of the cone along the conical surface indicating the correct direction of travel. The rope is connected at one end by a solid bronze ring and at the other end by a solid bronze swivel hook or a solid fixed hook. The bronze ring and hook are non-sparking and non-corrosive.

6 Claims, 3 Drawing Sheets

SAFETY DIRECTIONAL LINE FOR UNDERGROUND MINING AND METHOD OF MAKING SAME

BACKGROUND OF THE INVENTION

1. Field of the Invention

The present invention relates to safety lines for coal miners. More specifically, the invention is a safety guide line for assisting miners in dark areas, and the method of securing the line.

2. Description of the Related Art

There are several dangers that are inherent to mining operations. Within a coal mine there are numerous tunnels and pathways, only a few of which lead directly to the outside. In an emergency situation inside a mine, it is easy for even experienced miners to lose their direction. The tunnels are extremely dark, and in the event that a fire breaks out, the situation is far worse.

Several states have mandated that some sort of escape route markers or lines be utilized within the mine in order for miners to find their way to the outside with little visibility. Each state has set its own regulations concerning the distance which can separate each of the markers along the safety line. For example, Virginia requires that there be 75 feet between directional indicators, while West Virginia requires there be 25 feet between directional indicators.

What is needed is a safety directional line for underground mining which is easily followed by miners and which has indicators along the line which can be adjusted at the manufacturing stage such that the distance between adjacent indicators can be modified to comply with local requirements. It is imperative that the line be able to withstand great stress as there would likely be several people placing strain on the line at one time.

Mine safety lines and markers have been disclosed in prior patents. U.S. Pat. No. 4,179,160 issued on Dec. 18, 1979 to Sabo discloses a mine life line system which utilizes conical markers along the line such that when the miner is leaving the mine in the proper direction his hand slides smoothly along the cone. When he is heading in the wrong direction, his hand meets with an abrupt slope and is stopped. The line is supported by a spring loaded support which engages the floor and ceiling of the mine shaft. The drawback of the Sabo patent is that the conical indicator members are integrally formed with the line such that they can not be adjusted to account for the different requirements among states as in the present invention.

U.S. Pat. No. 4,401,050 issued on Aug. 30, 1983 to Britt et al. discloses a phosphorescent escape route indicator. The indicator is in the form of an adhesive strip that can be applied to the surface of walls or stairways to aid in delineating escape routes or access routes to emergency equipment during emergency situations. The patent to Britt et al. does not teach the use of conical members along a guide wire as in the present invention.

U.S. Pat. No. 4,844,000 issued on Jul. 4, 1989 to Clement discloses a direction indicating clamp for attachment to fire fighting hoses which indicates direction to exit the building. The clamps disclosed in Clement are not clearly visible in dark situations such as mining operations. The fire fighter must grab the hose and search for an indicator clamp. The Clement patent does not teach the use of fluorescent indicating material with the direction indicator or the line itself as in the present invention.

U.S. Pat. No. 5,027,741 issued on Jul. 2, 1991 to Smith et al. discloses a direction indicating means along a fire hose such that when a fire fighter is attempting to exit a building he can follow the directional indicators along the surface of the hose. If the fire fighter is traveling in the wrong direction the indicator means will resist motion in that direction. If he is traveling in the correct direction, his hand will glide easily along the hose. The patent to Smith et al. does not disclose the use of adjustable indicators as in the present invention.

None of the above inventions and patents, taken either singularly or in combination, is seen to describe the instant invention as claimed. Thus a safety directional line for underground mining solving the aforementioned problems is desired.

SUMMARY OF THE INVENTION

The present invention comprises a safety directional line for underground mining operations that can be adjusted when manufactured to conform with any local codes. The line is constructed from high strength polypropylene which is non-conductive. A flame retardant is added to the polypropylene to make it flame resistant. There are flame retardant, non-conductive directional indicator cones evenly spaced and positioned such that they are pointing along the axis of the line. The cones are placed on the line such that when someone is exiting the mine his hand slides along the slope of the cone and meets little resistance. In the event that the miner is traveling the wrong direction, his hand will meet the flat surface of the cone and come to a stop, indicating that he is traveling in the wrong direction.

There is fluorescent tape on the cones to make it more clearly visible to one trying to exit the mine. The tape is formed in an X on the flat surface of the cone indicating that it is the wrong direction. Additionally, the tape is placed parallel to the axis of the cone along the conical surface indicating the correct direction of travel.

The rope is connected at one end by a solid bronze ring and at the other end by a solid bronze swivel hook or a fixed hook. The bronze ring and hook are non-sparking and non-corrosive. The rope is tied in such a manner that it is able to withstand excessive strain.

Accordingly, it is a principal object of the invention to provide an improved safety directional line for mining operations wherein the direction of the mine exit is easily ascertained by the miner trying to exit the mine.

It is another object of the invention to provide a safety directional line for mining wherein the line is connected by non-sparking, non-corrosive connectors.

It is a further object of the invention to provide a safety directional line for mining wherein the indicator cones along the line are adjustable during manufacture to account for the different requirements among the states.

It is yet another object of the invention to provide a safety directional line for mining wherein the junction of the line and its connection to the wall is able to withstand great strain.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
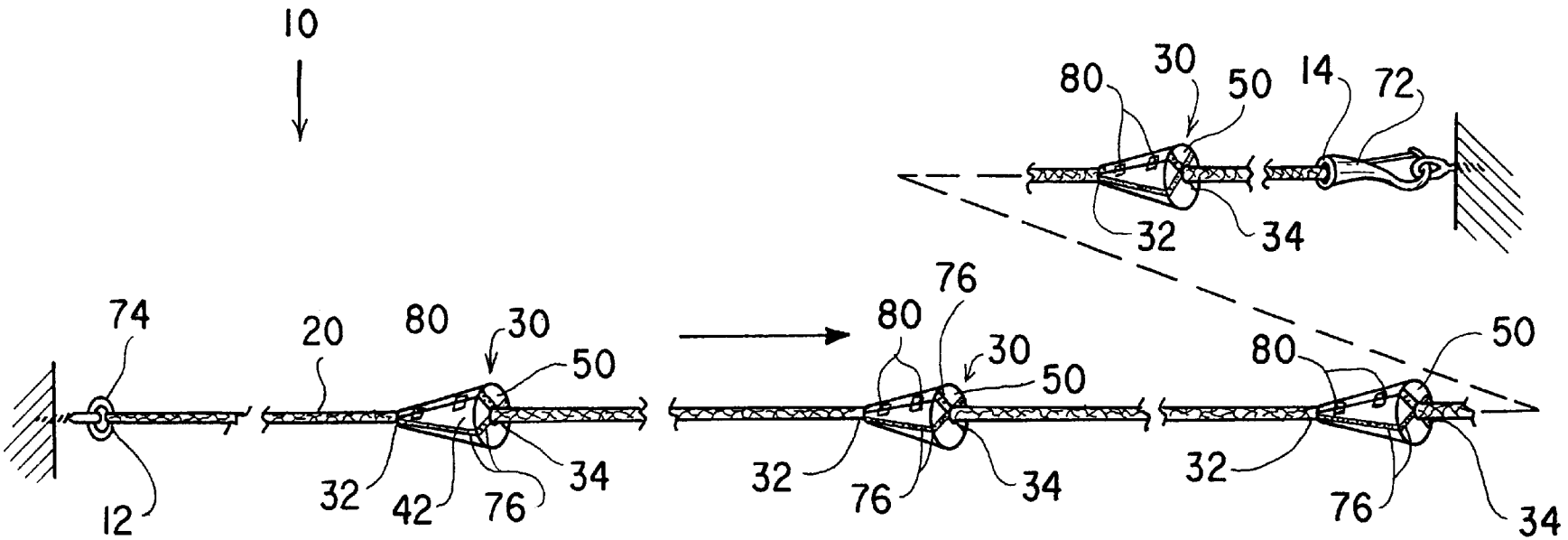
FIG. 1 is an environmental, perspective view of a safety directional line for underground mining according to the present invention.

The present invention comprises a safety directional line 10 for underground mining operations that can be adjusted during manufacture to conform with local codes. The safety directional line 10 has a first end 12 and a second end 14 and comprises a rope 20, a plurality of directional indicator members 30, and connecting means. The rope 20 is constructed from high strength polypropylene which is non-conductive. A flame retardant is added to the polypropylene to make it flame resistant.

Figure 2:
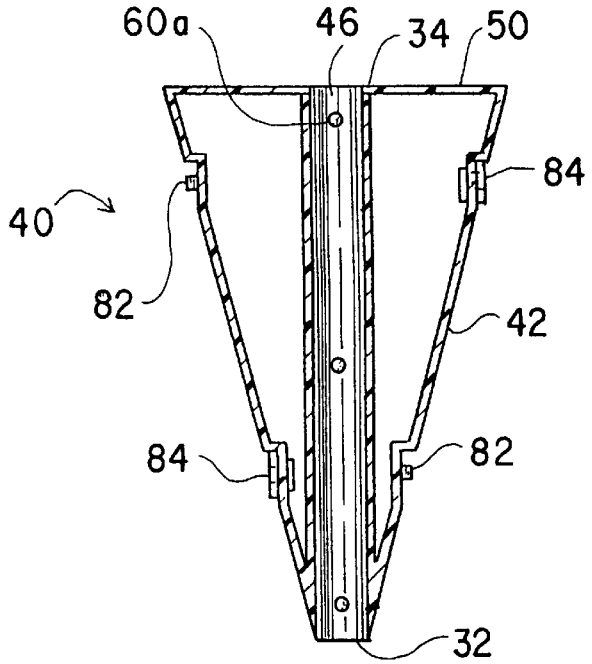
FIG. 2 is a horizontal cross section of an indicator cone according to the present invention.
Figure 3:
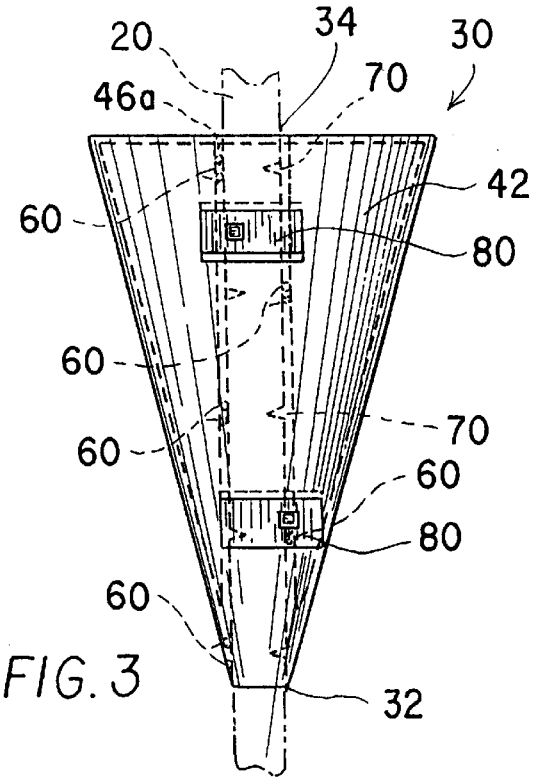
FIG. 3 is an elevation of an indicator cone according to the present invention.

The directional indicator member 30 has a first end 32 and a second end 34 and comprises two identical cone forming sections 40 (FIGS. 2–4) which have a conically shaped side wall 42 on one side and an opposite flat side wall 44, forming half cone-shaped cavity therein. The flat side wall 44 is provided with a semicircular channel 46 therein which extends from the first end 32 to the second end 34. There is a semicircular end plate 50 integrally formed with the cone forming section 40 on the second end 34. There is a semicircular section defined on the end plate 50 which is concentric with the channel 46 on the flat side wall 44. There are a series of receptor holes 60 along the conical side wall 42 and corresponding holes 60*a* along the channel 46 in the flat side wall 44 for receiving retaining pins 70. The two cone-forming sections 40 are removably coupled, whereby the directional indicator member 30 has a continuous side wall 42 which extends outwardly from the first end 32 to the second end 34 defining a conical outer configuration and an inner tube which defines a circular channel 46*a* extending through the center of the directional indicator member 30 along its horizontal axis from the first end 32 to the second end 34. The circular channel 46*a* is adapted for receiving the rope 20.

The directional indicator member 30 is further provided with retaining pins 70 which hold the directional indicator member 30 in place along the rope 20. The pins 70 are placed through receptor holes 60 in the side wall 42 and the holes 60*a* in the channel 46*a* of the directional indicator member 30 and into the rope 20, thereby securing the directional indicator member 30 in place.

Figure 4:
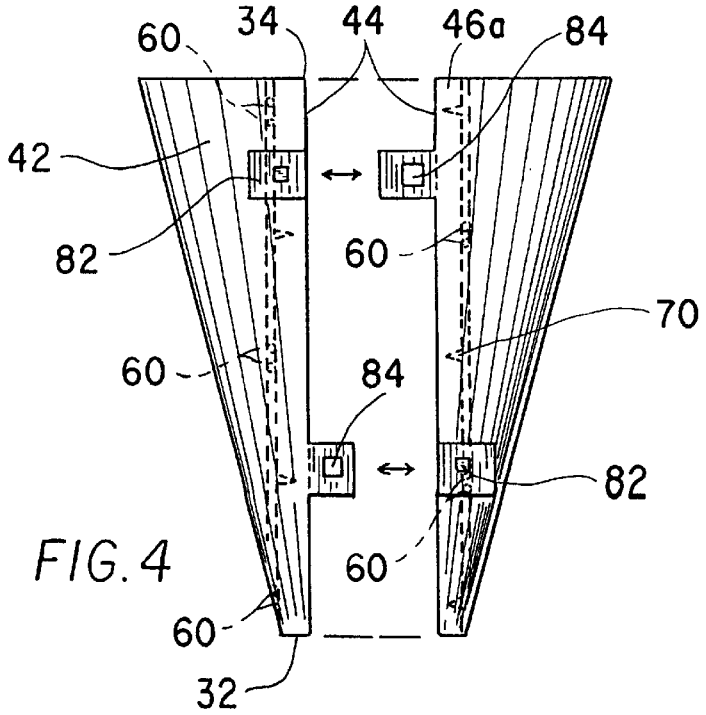
FIG. 4 is an exploded view of an indicator cone according to the present invention.

The two cone-forming sections 40 of the directional indicator member 30 are coupled by engaging snap together clips 80 as best seen in FIG. 4. The clips have a male side 82 and a female side 84 and are known to those skilled in the art. The directional indicator members 30 can be easily adjusted along the rope 20 by removing the retaining pins 70 and unsnapping and disengaging the cone-forming sections 40. This adjustability allows the directional safety line 10 to be adapted for compliance with any local code.

The directional indicator members 30 are placed on the rope 20 with the first end 32 of the directional indicator member 30 facing the first end 12 of the directional line 10 such that when someone is exiting the mine his hand slides along the slope of the directional indicator member 30 and meets little resistance due to the gradual slope of the indicator member side wall 42. In the event that the person is traveling the wrong direction, his hand will meet the flat end cap 50 of the indicator member 30 and come to an abrupt stop, indicating that he is traveling in the wrong direction. This is best seen in FIG. 1 with the arrow indicating the direction of the exit of the mine.

There is a bronze swivel hook 72 or a fixed hook (not shown) attached to the second end 14 of the safety line 10 in order to attach it to the wall of the mine. The first end 12 of the safety line 10 is provided with a bronze ring 74 to attach the safety line 10 to the opposite end of the mine near the entrance. The swivel hook 72 prevents the rope 20 from being tangled. The bronze ring 74 and hook 72 are non-sparking and non-corrosive. The ring 74 and hook 72 need not be placed on the line in this manner, but can alternatively be affixed to either end.

There is fluorescent tape 76 on the directional indicator members 30 to make them more visible to one trying to exit the mine. The tape 76 is formed in an X on the end plate 50 of the directional indicator member 30 indicating that it is the wrong direction of travel to exit the mine. Additionally, the tape 76 is placed parallel to the axis of the directional indicator member 30 along the side wall 42 indicating the correct direction of travel.

Figure 5:
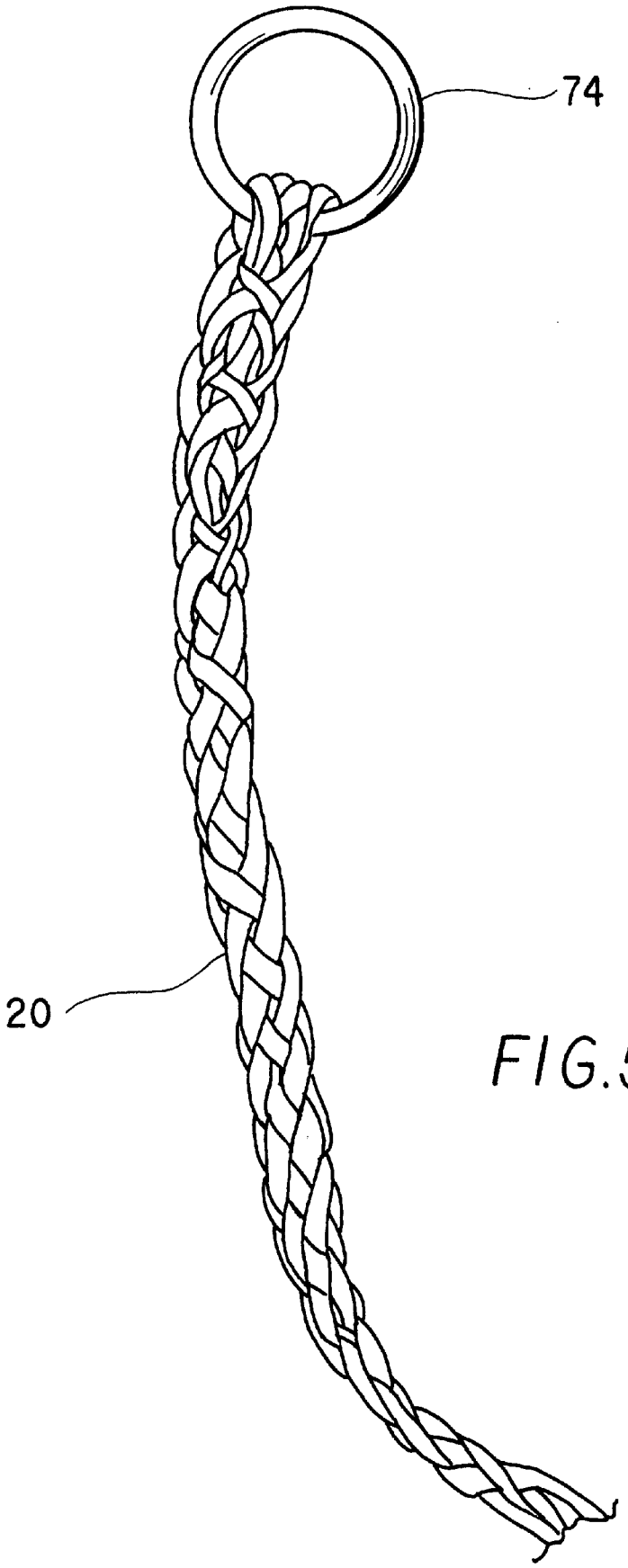
FIG. 5 is a perspective view of a rope tied according to the method of the present invention.

The rope 20 is tied in such a manner that the ring and hook will not easily become disconnected under strain. Several feet of rope are fed through the hook 72 or ring 74. The end of the rope 20 is pulled tightly while the free end of the rope is threaded through itself every other braid, forming an X-shaped pattern, at least twice, and the left over rope, ideally at least one foot, is fed down into itself. The result of using this method of tying the rope is best seen in FIG. 5.

It is to be understood that the present invention is not limited to the embodiments described above, but encompasses any and all embodiments within the scope of the following claims.

We claim:

1. A safety directional line for underground mining comprising:

a rope;

a pair of fasteners for attaching said rope to a wall;

a plurality of directional indicator members, each said directional indicator member comprising two identical cone-forming sections each having a first end and a second end;

a first side wall extending outwardly from said first end to said second end defining a half-conically shaped surface;

a second side wall having a flat surface opposite said conically shaped surface, wherein said cone forming section is semicircular in cross section; and wherein said second side wall is provided with a channel therein extending along the length of said cone-forming section from said first end to said second end; a semicircular end plate having a circular edge and a flat edge integrally formed with said second side wall and having a section removed from said flat edge which is concentric with said channel in said second side wall of said cone-forming section; a plurality of receptor holes along said first side wall and corresponding holes along said channel in said flat surface; a plurality of retaining pins for insertion into said receptor holes; a coupling means for joining said cone-forming sections of each said member; whereby, upon joining said cone-forming sections of each said member such that said second side walls, and said first ends and said second ends are adjacent, said coupling means are engaged and said cone-forming sections of each said member form a continuous side wall which extends outwardly from said first end to said second end defining a conical outer configuration and an inner wall which defines a circular channel extending through the center of said indicator member; said rope being threadedly inserted into said circular channel of each said member and said retaining pins are inserted in said receptor holes and said holes along said channel and engage said rope.

2. A safety directional line for underground mining according to claim 1 wherein said rope and said directional indicator members are made from non-conductive, flame retardant polypropylene.

3. A safety directional line for underground mining according to claim 2, wherein said pair of fasteners comprises a bronze hook and a bronze ring.

4. A safety directional line for underground mining according to claim 3 wherein said hook is a swivel hook.

5. A safety directional line for underground mining according to claim 3 wherein said coupling means is an interlocking snap-assembly.

6. A safety directional line for underground mining according to claim 1 wherein each direction indicator member further comprises reflective tape on its continuous side wall along the length of the cone forming sections and further comprises reflective tape in an X shape on said end plate.

* * * * *